United States Patent [19]

Adams

[11] 4,369,358

[45] Jan. 18, 1983

[54] TABLE CORRELATING DEVICE FOR SCUBA DIVERS

[76] Inventor: William Adams, 1965 Garfield Ave., Salt Lake City, Utah 84108

[21] Appl. No.: 252,155

[22] Filed: Apr. 8, 1981

[51] Int. Cl.[3] ..... G06C 3/00; G06C 27/00

[52] U.S. Cl. ..... 235/79.5; 235/87 R

[58] Field of Search ..... 235/79, 79.5, 87 R, 235/87 A, 89 R

[56] References Cited

U.S. PATENT DOCUMENTS

| | | | |
|---|---|---|---|
| 2,595,153 | 4/1952 | Malmgren | 235/87 R |
| 2,958,251 | 11/1960 | Calabro | 235/87 R |
| 2,970,758 | 2/1961 | Abbate | 235/87 R |
| 3,058,653 | 10/1962 | Des Granges | 235/88 R |
| 3,578,241 | 5/1971 | Wombough et al. | 235/88 R |

*Primary Examiner*—Benjamin R. Fuller

*Attorney, Agent, or Firm*—Mallinckrodt & Mallinckrodt

[57] ABSTRACT

An apparatus used to correlate and selectively read information from tables dealing with the extent of nitrogen absorption in a scuba diver's body. Tables containing information relating to the amount of time a diver spends at various depths, decompression procedures, the surface interval between repetitive dives, and the resultant amount of nitrogen accumulation in the diver's body are attached to an inner tube. Two side-by-side outer tubes, each having sight windows for selective reading of the tables, are arranged concentrically about the inner tube, and are secured in lateral position by end caps attached to the inner tube. Each outer tube is provided with inwardly projecting flanges on each end which serve as bearing surfaces for rotation about the inner tube. The apparatus is preferably slipped over a scuba tank air hose for carrying.

10 Claims, 5 Drawing Figures

TABLE CORRELATING DEVICE FOR SCUBA DIVERS

BACKGROUND OF THE INVENTION

1. Field:

The invention is in the field of apparatus used by scuba divers, and particularly relates to apparatus used to indicate the extent of gas accumulation in the body of a scuba diver.

2. State of the Art:

A column of fresh water 33 feet high or sea water 32 feet high exerts one atmosphere of pressure. Since the water surface is already at one atmosphere pressure, the pressure at a depth of 33 feet in fresh water is two atmospheres, and the pressure increases by one atmosphere for every 33 feet further that one descends. Thus, at a depth of 100 feet, the pressure exerted on a diver will be about four atmospheres.

As a diver descends and the pressure on his body increases, any gases in air chambers, such as his lungs, are compressed. At a depth of 33 feet, where the pressure is two atmospheres, the volume of air in his lungs is compressed to one-half the volume it will fill at sea level. Similarly, at 100 feet, where the pressure is four atmospheres, the air will be compressed to one-fourth of its volume at sea level.

In order to counteract the effects of pressure on a diver as he descends, and allow him to breathe properly, he is supplied with required quantities of air from tanks of compressed air. However, even though this permits the diver's lungs to maintain their normal volume, and the diver suffers no ill effects, the pressure of the air in his lungs is increased in proportion to the depth at which he is diving.

Air is made up primarily of oxygen (about 20%) and nitrogen (about 80%). At sea level, approximately one liter of nitrogen is dissolved in an average person's body. Nitrogen is about five times more soluble in fat as in water so that more than half of the nitrogen is dissolved in body fats, even though fats only make up about 15% of the body.

Due to the increased pressure of air in his lungs, the amount of oxygen and nitrogen which dissolves in a diver's body also increases. Nitrogen is not metabolized by the body, so it remains dissolved in the body to an extent dependent on the external pressure. Oxygen, on the other hand, is metabolized and thus is not generally a problem when a diver breathes compressed air. For each increase in pressure of one atmosphere, an additional liter of nitrogen will dissolve in his body. Thus, at 33 feet a diver will have two liters of nitrogen dissolved in his body; at 100 feet his body will contain four liters. However, the increased nitrogen does not dissolve in a diver's body instantly. Furthermore, the nitrogen dissolves at different rates in different parts of the diver's body. Water in the diver's body becomes saturated with nitrogen in about one hour, whereas fat, which requires much more nitrogen before it is saturated, and also has a poor blood supply to carry the nitrogen, reaches saturation only after several hours. Thus, several hours are required before the body becomes saturated with nitrogen as all of the tissues in the body come into equilibrium with the gas pressure in the diver's lungs.

Unless the diver is at a depth of about 130 feet or more, such that he may begin to develop nitrogen narcossis, he will generally suffer no ill effects from the increased nitrogen dissolved in his body, as long as he remains submerged. However, as he ascends, the pressure on his body decreases and excess nitrogen is liberated from his body fluids and tissues. If the ascent is too rapid, actual bubbles of nitrogen will form. Bubbles forming in the brain, spinal cord, or peripheral nerves can cause paralysis or convulsions, or other effects. Bubbles in the joints or muscles can cause severe pain. Nitrogen bubbles in the respiratory system can cause difficulty in breathing and heavy coughing. In any event, the experience is unpleasant and could result in permanent injury. To avoid these effects a diver must either ascend slowly enough to allow the excess nitrogen to be expelled slowly from his body without bubble formation, or he must ascend before too much extra nitrogen has dissolved in his body.

The amount of nitrogen which actually dissolves in a diver's body is a function of the depth to which he descends, and the length of time he remains there.

The U.S. Navy has published numerous tables indicating safe procedures to be used to avoid formation of nitrogen bubbles in a diver's body. It has been discovered that the mere fact that excess nitrogen is present in a diver's body does not mean that nitrogen bubbles will necessarily form. Nitrogen can be "supersaturated" in a diver's body so that only an insignificant quantity of nitrogen bubbles will form even where the quantity of dissolved nitrogen is greater than the amount the body would normally hold at a given pressure. The U.S. Navy tables allow some excess nitrogen to remain in a diver's body during his ascent. However, it should be noted that the various tables are based on an "average" diver. A particular diver may be more or less susceptible to formation of nitrogen bubbles in his body.

A diver using the Navy Tables must take into account the fact that when he surfaces, his body will be supersaturated with nitrogen to some extent. Thus, a diver making a second dive shortly after completing the first must adjust for the excess nitrogen in his body. The Navy has published a diving manual containing a set of tables for use where a diver makes repetitive dives. One of these tables sets forth various times at which a diver can remain at specified depths without requiring decompression. When a diver intends to make a second or subsequent dive, a second table is used to account for the amount of time a diver spends at the surface between dives. The second table leads into a third table which tells a diver his "residual nitrogen times" at various depths. These residual times are the times a diver must assume he already has spent at a given depth when he starts a repetitive dive. The U.S. Navy has also published various tables to be used where decompression is necessary. Depending upon the circumstances, these tables set forth periods of time which a diver must spend decompressing at various depths as he ascends from a dive made at a deeper depth.

A diver needs to have access to the information contained in some of these tables during each dive he makes. The most common method of carrying this information is on a plastic card having the tables printed thereon. Typically, a plastic card used for this purpose measures between four to six inches wide and between eight to ten inches long, and is provided with a hole through which a chain or cord passes for use in securing the card to the diver. The problem with use of a card is that it is somewhat awkward to carry since it tends to flutter as a diver swims. It is also somewhat awkward to use because it is difficult to move from one table to another without losing one's place, thus making it likely that one will make a mistake and perhaps stay down too long. It is particularly difficult for a diver to use when he realizes he has been down too long and begins to panic.

One device that has partially solved these problems is disclosed in U.S. Pat. No. 3,058,653. This device is a circular slide-rule type "computer" which shows much of the information in windows, excluding much of the unwanted information from view. However, the device is designed to be carried similarly to the cards, and its size and shape makes it no more convenient to carry than a card. Also, the device still uses tables to convey some required information, with the attendant risk of slipping a line as one reads across, thus reading the wrong information.

SUMMARY OF THE INVENTION

The present invention solves the difficulties of using plastic cards having diving tables printed thereon, or the device of U.S. Pat. No. 3,058,653, by providing tables that may be selectively read and correlated, and are carried in a form that is extremely convenient to carry and use.

This is accomplished by attaching tables containing the desired information to an inner tube and arranging one or more outer tubes concentrically about the inner tube in a manner whereby the outer tubes are free to rotate about the inner tube. Providing sight windows in the outer tube allows selective reading of the tables.

A typical scuba tank is provided with accessory air hoses in addition to the air hose used to carry air to the diver. For instance, an air hose is usually provided for carrying a pressure gauge so that a diver may monitor the amount of air left in his tank. The table correlating device may be conveniently slipped over this air hose before connecting said hose to the scuba tank, thus holding the device out of the way when unneeded. Yet, the diver has easy access to it by pulling the hose around in front of him when he wishes to examine the information contained in the various tables.

THE DRAWINGS

In the accompanying drawings, which represents the best mode presently contemplated for carrying out the invention:

FIG. 1 is a perspective view of the table-correlating device of the invention;

FIG. 2, a longitudinal section taken along the line 2—2 of FIG. 1;

FIG. 3, a view showing the device secured to a hose attached to a scuba tank;

FIG. 4, a view of the labels used on the outer tubes of the invention to form and label the sight windows; and FIG. 5, a view of the label used on the inner tube of the invention containing the tables to be correlated or selectively read.

DETAILED DESCRIPTION OF THE ILLUSTRATED EMBODIMENT

Figure 3:
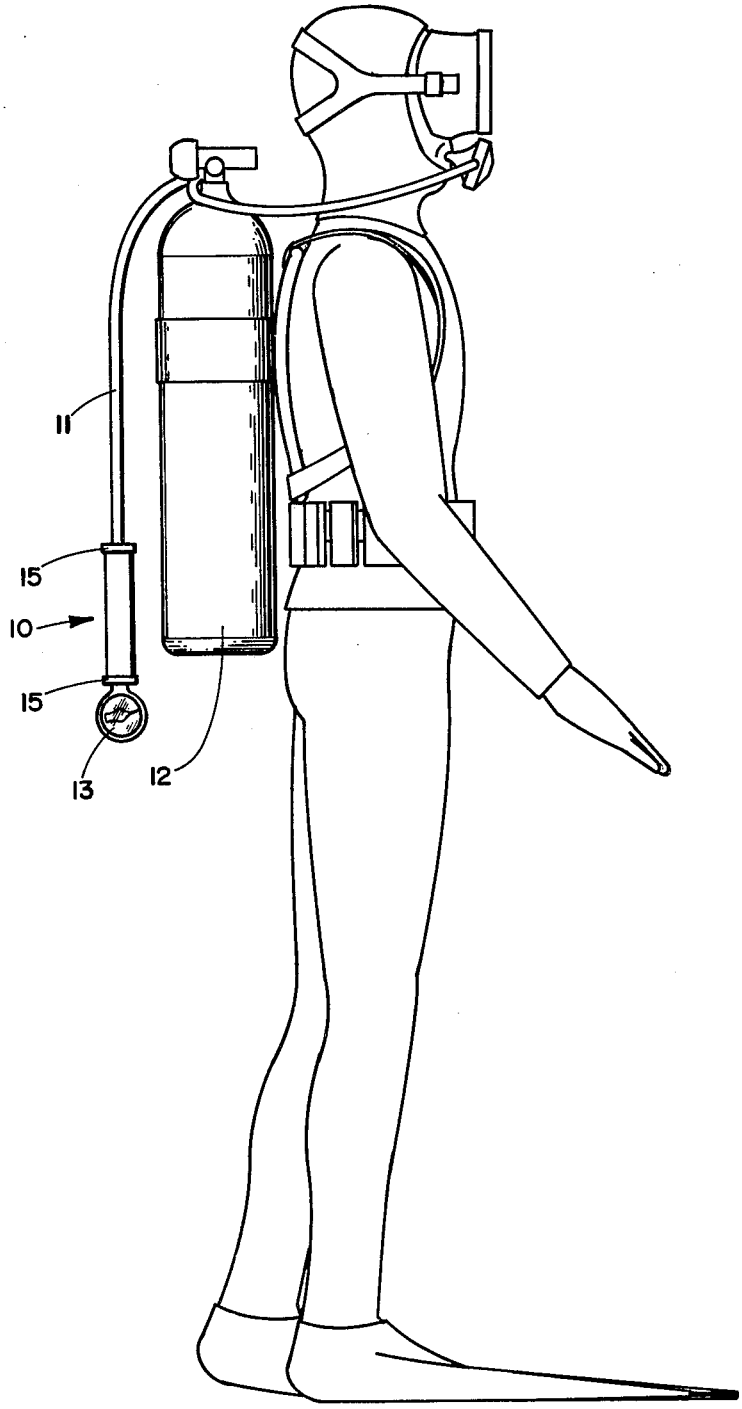

As can be seen in FIG. 3, the preferred embodiment of the device, shown generally at 10, is designed to be attached to an air hose 11 of a scuba tank 12. The particular hose 11 to which the device 10 is attached in FIG. 3, is a hose carrying a pressure gauge 13. This hose is long enough to allow the diver to pull the hose around so that he can read the gauge, yet the gauge is normally out of the way. Similarly, the device 10 can be read when desired, but is generally out of the way. Also, the device fits fairly closely around the air hose and does not hang loose, nor does it flutter as a diver swims.

The preferred embodiment of the device includes an inner tube 14 around which the other components of the device are arranged. The inside diameter of inner tube 14 should be somewhat larger than the diameter of the air hose 11. End caps 15, constructed of a flexible material, are friction fit onto the ends of inner tube 14. A hole 16 is provided in each end cap 15 to accommodate hose 11. Hole 16 should have a diameter slightly smaller than the diameter of air hose 11 so that the device 10 will be held securely in place on the air hose. The material in the area around hole 16 should be flexible enough to allow the end cap 15 to deform when the device is forced past the air hose fittings (not shown) and then spring back to its normal shape.

Figure 5:
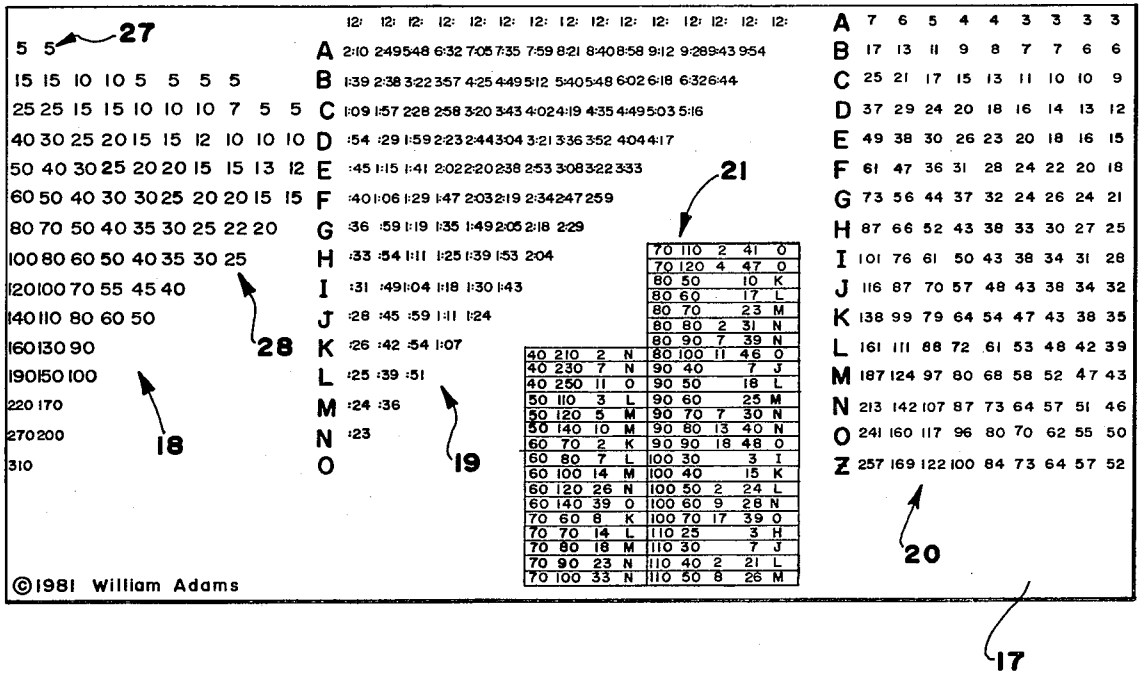

Various tables of information may be attached to inner tube 14 by means of a label 17, or by other method, such as silk screening the tables directly onto the inner tube. FIG. 5 shows a typical label which may be used. Shown in FIG. 5 as it would appear prior to attachment to the inner tube, label 17 should be sized so as to cover substantially the entire surface of inner tube 14 exposed between end caps 15. Label 17 of the presently preferred embodiment of the invention contains four separate tables, three of which are particularly designed to be used together. The information contained in each of these tables has been published by the U.S. Navy, although it has been rearranged here to appear in an original form. The first table, designated 18, contains information relative to the amount of time spent at various depths where no decompression is required. By itself, the value of this table is to set forth the maximum period of time a diver may spend at certain depths if he desires to ascend with no decompression stops.

The second table, designated 19, is to be used in conjunction with table 18. Table 19 accounts for the amount of time a diver remains at the surface after one dive before making a subsequent dive. Although table 18 sets forth safe limits for diving without the need for decompression stops, the diver will have some excess nitrogen in his body following a dive. As he spends time on the surface following a dive, the amount of nitrogen in his body will gradually decrease until it becomes "normal". This can require up to 12 hours. If a second dive is made before the nitrogen level in the diver's body has returned to normal, the time he may spend at a given depth is reduced by a factor proportional to the excess nitrogen remaining in his body from the previous dive. Table 19, in conjunction with table 20, is designed to take this into account.

Table 20 is designed to be used together with tables 18 and 19. Table 20 contains information relating to the amount of excess nitrogen which is actually present in a diver's body at some specific period of time following a dive, presented in terms of minutes which a diver should presume he has already spent at a given depth when he begins a subsequent, or repetitive dive to that depth.

Table 21 is somewhat independent from tables 18, 19, and 20. It is used where a diver exceeds the maximum safe limits of table 18 and requires decompression stops before ascending to the water surface. However, table 21 is keyed so that a diver may enter table 19 if he wishes to make a subsequent dive.

Additional information could optionally be added to tables 18–21 concerning other depths and bottom times. The information appearing in the tables as illustrated in FIG. 5 was selected as being sufficient for the needs of most divers and under most conditions. Of course, it would be a simple matter to alter the contents of the tables.

In the past, the information contained in tables 18–21 has been portrayed in a manner somewhat similar to that used in the present tables. Although a person could work through the tables and find the information he wanted, it was not uncommon for the user to inadvertently slip up or down a line as he read across. If a diver were to make such an error and failed to take into account the full extent of nitrogen accumulation in his body, he would run a serious risk of suffering decompression sickness.

Figure 1:
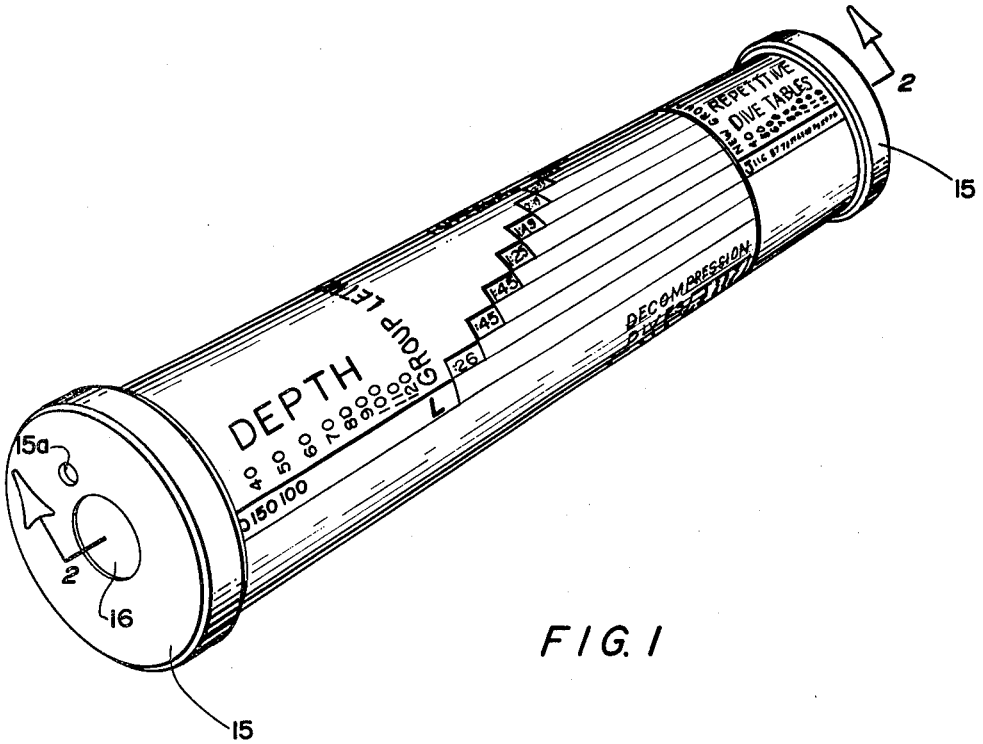
Figure 2:
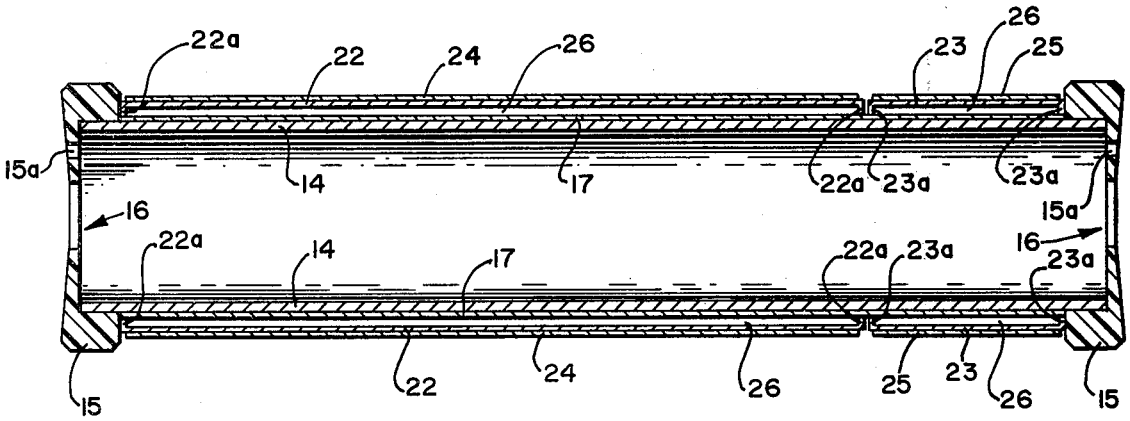

To avoid the chance that a diver might read the table improperly, the preferred embodiment of the invention employs two transparent outer tubes 22 and 23, FIGS. 1 and 2, onto which labels 24 and 25, respectively, are attached. As with label 17, use of labels 24 and 25 may be avoided by applying the information contained therein directly to the surface of tubes 22 and 23, as by silk screening. Optionally, opaque outer tubes may be employed and the sight windows actually cut out of said tubes.

The outer tubes 22 and 23 are provided with flanges **22*a* and 23*a*, respectively, which serve as bearing surfaces and also serve to space the interior surface of tubes 22 and 23 from the outer surface of label 17. Having such a space insures that rotation of outer tubes 23 and 24 does not wear off the information printed on the label, an especially important feature when diving in sandy waters. It is preferable that there be a small amount of clearance (not shown) between the flanges and label 17 so that rotation is free, and so that water may enter airspace 26 as the diver descends. It is also desirable to provide end caps 15 with ports 15*a* to allow free movement of water into the interior of inner tube 14**. If the device were water tight, there would be a possibility of breakage as a diver descended and the water pressure increased.

Another feature of the invention is the ability to quickly and easily disassemble the device for cleaning during a dive if it gets filled with sand. This is done by removing one of the end caps 15 from inner tube 14, and sliding it away from the device so that outer tubes 22 and 23 may in turn be moved away from inner tube 14. Hose 11 passes through each of the disassembled pieces so that by shaking of hose 11, water flow serves to wash any sand or other material free. The pieces may then be easily reassembled. Similarly, it is a simple matter to disassemble the device for cleaning at the completion of a dive.

Outer tube 22 is of a length sufficient to embrace the entirety of tables 18 and 19 within the flanges. Outer tube 23 is of a length sufficient to embrace the entirety of table 20 between its flanges. In the present embodiment, table 21 is also positioned between the flanges of tube 22.

Figure 4:
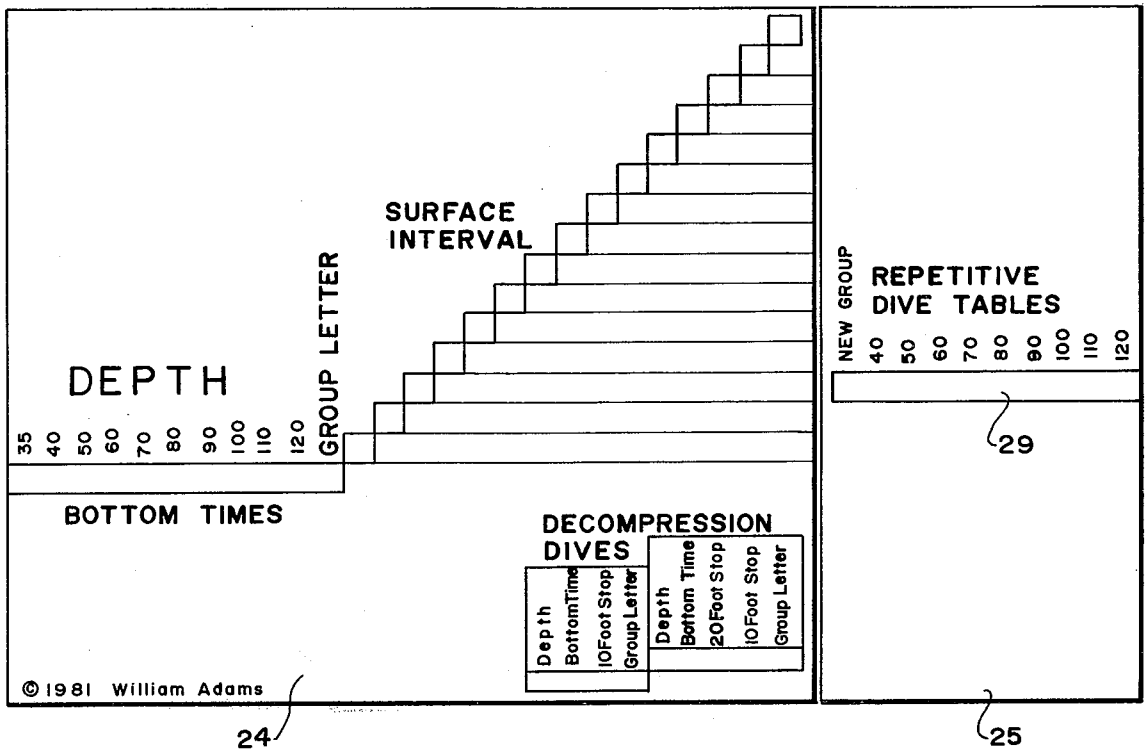

Labels 24 and 25 are illustrated in FIG. 4. Each label is sized so as to fit substantially the entire surface of outer tubes 22 and 23, respectively. Each of these labels is provided with sight windows which permit selective reading of the information contained in the various tables.

Rotation of tube 22 with respect to inner tube 14 permits selective reading of the horizontal columns of table 18, and the corresponding Group Letter of table 19. The information printed in table 18 represents the number of minutes spent at the depth indicated by the corresponding heading printed on label 24. Each vertical column of table 18 shows various times spent at a given depth. The first column of table 18 represents times spent at a depth of 35 feet, the second column represent time spent at 40 feet, and so on. Thus, the character "5", designated at 27 would represent five minutes spent at a depth of 40 feet. Similarly, the character "25", designated at 28, would represent 25 minutes spent at a depth of 100 feet.

In use, a diver would read from the column corresponding to the deepest depth to which he had descended and would rotate outer tube 22 until he found the length of time he had spent submerged, known as his "bottom time." If his bottom time was somewhere between two of the numbers listed in table 18, he would use the larger number.

A diver wishing to avoid the necessity for decompression would be required to ascend before he exceeded the limits set forth in table 18. Thus, a diver diving to a depth of 35 feet would be required to limit his dive to a total of 310 minutes, 310 being the last number in column 1, the 35 foot column. A diver diving to a depth of 100 feet would be required to limit his dive to only 25 minutes. A diver exceeding these limitations would be required to use table 21 to inform him of the appropriate decompression stops that he should make.

If a diver wishes to make a second dive after completing his first dive, he must take into account the excess nitrogen remaining in his body as a result of the first dive. The amount of excess nitrogen in his body is obtained from table 20. However, this amount is dependent upon the length of time he has been at the surface between dives. The surface interval between dives is taken into account by table 19.

To determine the amount of excess nitrogen in the diver's body, tube 22 is rotated so as to indicate the length of the dive and the maximum depth to which the diver descended, as explained above. The surface interval between dives is read in sight windows extending diagonally to the upper right from the Group Letter. These surface intervals are expressed as hours:minutes. If the actual surface interval is between two intervals shown in the sight windows, the next higher interval is used. Thus, if the actual surface interval is 3 hours and 35 minutes, and the sight windows showed one possible interval of 3:21 and the next higher of 4:19, the interval of 4:19 would be used. Although it appears at first glance that a diver is getting credit for being at the surface for more time than he actually spent, the tables are actually cast so that a diver surfaced from between 3 hours 22 minutes and 4 hours 19 minutes only gets credit for being on the surface for 3 hours 22 minutes (3:21 plus 0:01). A diver who has been out of the water for over twelve hours may assume that all excess nitrogen has had time to leave his body.

After the diver has found the appropriate surface interval, he rotates outer tube 23, without rotating tube 22, until sight window 29 of label 25 lines up horizontally with the selected surface interval. Then he moves to table 20. The numbers found in table 20 represent the number of minutes a diver must assume he has already spent submerged as he begins a dive to a particular depth.

The following examples will illustrate the manner of use of the device:

EXAMPLE 1

A diver enters the water at 8:00 A.M. and descends to 100 feet. He surfaces at 8:25 A.M. and wants to know if he can make another dive to 100 feet at 9:00 A.M., and how long he can stay down if he wants to avoid the need for decompression.

The diver's "bottom time" is "25" minutes in this example. By rotating outer tube 22 until the number "25" appears in the sight window under the Depth heading "100", and reading to the right, he finds that he is in "Group H" at the end of his dive. If he wishes to dive again at 9:00 A.M., his surface interval will be 35 minutes. Thus, he will rotate outer tube 23 until its sight window lines up horizontally with the "0:36" exposed in Table 19. After a surface interval of only 35 minutes, the diver finds that he still remains in Group "H". Reading the Repetitive Dive Tables (table 20), under the heading "100", the diver finds that he must consider himself to have already spent 30 minutes at a depth of 100 feet as he begins his dive. Thus, he cannot make another dive to 100 feet at 9:00 A.M. if he wishes to avoid the need for decompression procedures.

It is interesting to note that the 30 minute figure he obtains from the Repetitive Dive Table is greater than the actual time he spent on his first dive. However, the information in these tables was published by the U.S. Navy, and serves as a standard throughout the diving industry.

EXAMPLE 2

Assume the diver of Example 1 decides to dive to only 60 feet on the second dive instead of to 100 feet. Looking at the Repetitive Dive Tables under the heading "60", he finds that he must consider himself to have spent 52 minutes at the depth of 60 feet as he starts his second dive at 9:00 A.M. Moving back to the Bottom Times table, he can rotate outer tube 22 until a blank space appears under the Depth heading "60". Rotating back slightly, he finds the number "60" under the heading "60". This means that the maximum allowable time he may spend at 60 feet without requiring decompression is a total of 60 minutes. Since he already has the equivalent amount of nitrogen in his body corresponding to a dive of 52 minutes at 60 feet, he must limit his second dive to only 8 minutes.

EXAMPLE 3

The diver of Example 2 decides to make the dive at 9:00 A.M. to a depth of 60 feet, but stays down for a total of 25 minutes. Before ascending, he checks his time and the tables and finds that he has exceeded the time limit for no decompression dives: he has to use a bottom time figure of 77 minutes (52 minutes from the Repetitive Dive Tables plus 25 minutes actual bottom time on this dive). Rotation of outer tube 22 discloses that decompression requirements are specified for 70 minutes at 60 feet, and for 80 minutes at 60 feet. Using the 80 minute entry, the diver finds that he may ascend normally to a depth of 10 feet, at which point he must stop for 7 minutes before surfacing. He further finds that he will be in Group "L" at the completion of this dive.

EXAMPLE 4

After completing the dive in Example 3, the diver wishes to make one final dive, this one again to 100 feet. To determine his residual nitrogen content, he must rotate outer tube 22 until Group Letter "L" appears in the corresponding sight window.

Before his final dive, he remains surfaced for 5 hours. The surface interval sight windows show a next-higher interval of "6:02". Lining up the sight window of the Repetitive Dive Tables with the "6:02" in the surface interval sight window, the diver finds that he is now in New Group "C". Reading the table entry under the heading "100", the diver finds that he must consider himself to have spent 10 minutes at a depth of 100 feet even as he begins his dive. Rotation of outer tube 22 and reading Bottom Time figures for 100 feet discloses a maximum no-decompression dive time of 25 minutes. Thus he can make an actual dive of 15 minutes (25 minutes minus the 10 minutes from the Repetitive Dive Tables) without requiring decompression stops.

Whereas this invention is here illustrated and described with specific reference to an embodiment thereof presently contemplated as the best mode of carrying out such invention in actual practice, it is to be understood that various changes may be made in adapting the invention to different embodiments without departing from the broader inventive concepts disclosed herein and comprehended by the claims that follow.

I claim:

1. A device for use in determining the amount of nitrogen absorption in the body of a scuba diver, comprising:

an elongate inner cylinder to which are attached, longitudinally thereof, three side-by-side tables dealing with variables affecting the amount of said nitrogen absorption;

two separate outer tubes arranged concentrically about and side-by-side longitudinally of the inner cylinder as sleeves so that the inner cylinder and outer tubes may be rotated relative to one another, one of said outer tubes comprehending two of said tables and the other of said outer tubes comprehending the third of said tables and each of said outer tubes being provided with sight windows to allow selective reading and correlating of said tables; and means for maintaining each of said outer tubes in proper relationship to the inner cylinder, whereby the sight windows are maintained in proper relationship with the respective tables.

2. A device according to claim 1, wherein one of the two tables contains information relating to the amount of time spent at a given depth, the other of the two tables contains information relating to the amount of time a diver spends at the surface between repetitive dives, and the third table contains information relating to the amount of nitrogen remaining in the diver's body after a specified time at the surface.

3. A device according to claim 1, including means for maintaining the inside surface of each of said outer tubes in spaced relationship with the outer surface of the inner cylinder.

4. A device according to claim 3, wherein each of the outer tubes is provided with an inwardly projecting flange at each end thereof as the means for maintaining each said tube in spaced relationship with the inner cylinder.

5. A device according to claim 1, wherein a table containing information relating to decompression stops required at the completion of a dive is also provided on the inner cylinder within the area comprehended by the one outer tube, and wherein a corresponding sight window is provided in the said one outer tube.

6. A device according to claim 1, wherein the inner cylinder is a tube having an inside diameter sufficiently large to allow the air hose of a scuba tank to pass therethrough.

7. A device according to claim 6, wherein the means for maintaining each outer tube in proper relationship to the inner tube are end caps secured to the ends of the inner tube, respectively, and adapted to keep each of the outer tubes from significant lateral movement while allowing rotational movement; and wherein each end cap is provided with an opening for receiving the air hose of a scuba tank, whereby the device may be secured to such a hose.

8. A device according to claim 7, wherein each end cap is constructed of a sufficiently flexible material such that it will pass over the pressure gauge attachment fitting of the air hose of the scuba tank.

9. A device according to claim 7, wherein at least one of the end caps is easily removable from the inner tube to permit disassembly of the device without detachment of any part thereof from the air hose of the scuba tank.

10. A device according to claim 6, wherein the outer tubes are spaced from the inner tube and the space between said tubes and the interior of the inner tube are open to the inflow of water when the device is being used, so as to equalize the pressure operative on said tubes.

* * * * *